US007438049B2

(12) United States Patent
Caretta et al.

(10) Patent No.: US 7,438,049 B2
(45) Date of Patent: Oct. 21, 2008

(54) SYSTEM FOR DETERMINING THE START OF COMBUSTION IN AN INTERNAL COMBUSTION ENGINE

(75) Inventors: Gianluca Caretta, Regensberg (DE); Rainer Hirn, Neutraubling (DE); Antonio Lentini, Cannobio (IT)

(73) Assignee: Siemens Aktiengesellschaft, Munich (DE)

( * ) Notice: Subject to any disclaimer, the term of this patent is extended or adjusted under 35 U.S.C. 154(b) by 17 days.

(21) Appl. No.: 11/621,760

(22) Filed: Jan. 10, 2007

(65) Prior Publication Data

US 2007/0186905 A1 Aug. 16, 2007

(30) Foreign Application Priority Data

Jan. 10, 2006 (DE) ..... 10 2006 001 271

(51) Int. Cl.
*F02P 5/10* (2006.01)

(52) U.S. Cl. ..... 123/406.41; 123/406.43; 123/435

(58) Field of Classification Search ..... 123/435, 123/406.41, 406.43
See application file for complete search history.

(56) References Cited

U.S. PATENT DOCUMENTS

| | | | | |
|---|---|---|---|---|
| 7,000,596 | B2 * | 2/2006 | Zurloye et al. | 123/435 |
| 7,066,138 | B2 | 6/2006 | Damitz et al. | 123/299 |
| 7,178,507 | B1 * | 2/2007 | Gangopadhyay | 123/435 |
| 2001/0017127 | A1 | 8/2001 | Flynn et al. | 123/435 |
| 2002/0195086 | A1 * | 12/2002 | Beck et al. | 123/435 |

FOREIGN PATENT DOCUMENTS

| | | | |
|---|---|---|---|
| DE | 197 49 815 | A1 | 5/1999 |
| DE | 199 00 738 | C1 | 6/2000 |
| DE | 10 2004 033 072 | A1 | 7/2005 |
| DE | 10 2004 001 119 | A1 | 8/2005 |
| EP | 0 851 107 | A2 | 7/1998 |
| EP | 1 607 604 | A1 | 12/2005 |

OTHER PUBLICATIONS

Sellnau et al. "Cylinder-Pressure-Based Engine Control Using Pressure-Ratio-Management and Low-Cost Non-Intrusive Cylinder Pressure Sensors" SAE Technical Paper Series (22 pages), Mar. 9, 2000.

Bauer "Ottomotor-Management" Vieweg Verlag (4 pages), May 2003.

* cited by examiner

*Primary Examiner*—Erick Solis
(74) *Attorney, Agent, or Firm*—Baker Botts L.L.P.

(57) ABSTRACT

The start of the combustion (CRK) of a mixture in a combustion chamber of an internal combustion engine is determined in accordance with a pressure ($p_c$) that is measured in the combustion chamber.

24 Claims, 6 Drawing Sheets

SYSTEM FOR DETERMINING THE START OF COMBUSTION IN AN INTERNAL COMBUSTION ENGINE

RELATED APPLICATION

This application claims priority from German Patent Application No. DE 10 2006 001 271.2, which was filed on Jan. 10, 2006, and is incorporated herein by reference in its entirety.

TECHNICAL FIELD

The invention relates to a method for determining the start of combustion as well as an engine controller and a use of an engine controller.

BACKGROUND

Internal combustion engines with reciprocating pistons that move within cylinders and thus form combustion chambers are sufficiently well known from prior art. In recent years numerous devices and methods have been suggested for improving the combustion of the mixture introduced into the combustion chamber in order to improve control of the combustion process and enable a more environmentally friendly combustion of the mixture. A known method is to measure the pressure in the cylinder. By referring to the changes over time in the volume of the combustion chamber, which can be determined from the geometrical relationships between the internal combustion engine and the crank shaft angle of rotation, it is possible to determine among other things the energy being released during a combustion process, in order to improve combustion by taking this variable and others into account.

When determining the parameters of the combustion process, the conventional wisdom is to proceed from the assumption that a mixture in the combustion chamber begins to react chemically, that is, to burn, after certain physical and environmental conditions such as pressure and temperature have occurred or following ignition by a spark plug. Proceeding from the start of combustion estimated on this basis, a conclusion about the further progress of the combustion is reached by reference to further determined variables. The problem with this method is that if an incorrect assumption is made about the start of combustion, further calculations are likewise prone to error.

SUMMARY

The object of the invention is therefore to remedy the disadvantages of the prior art and in particular to specify a device and a method by which the combustion process in an internal combustion engine can be better monitored.

This object can be achieved by a method for determining the start of combustion of a mixture in the combustion chamber of an internal combustion engine, comprising the following step:

measuring the pressure in the combustion chamber, and determining the start of combustion by reference to the measured pressure.

BRIEF DESCRIPTION OF THE DRAWINGS

Other advantageous embodiments of the invention are contained in the subclaims or are explained below together with the description of the preferred exemplary embodiment of the invention with the aid of the drawings. These show the following:

DETAILED DESCRIPTION

Figure 1:
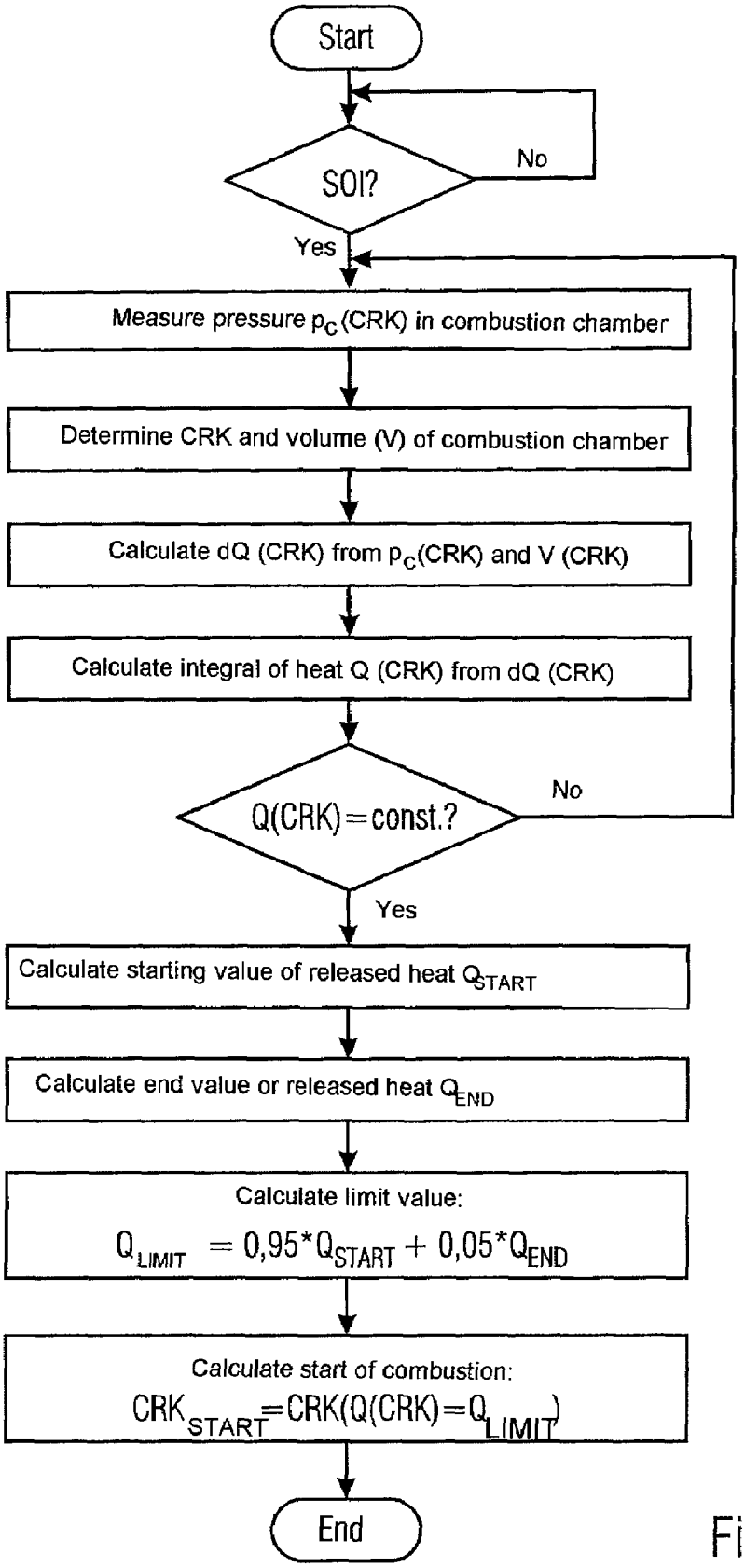
FIG. 1 shows a flowchart of an inventive method for determining the start of combustion.

The invention is based on the finding that following measurement of the pressure in the combustion chamber the start of combustion can be determined by reference to the measured pressure, since the pressure changes noticeably when combustion begins. The invention offers the advantage that the combustion process can be better analyzed by precisely determining the start of combustion. The pressure in the cylinder can be determined for instance by means of a pressure sensor arranged in the heater plug. The signal from the pressure sensor is sent to an engine controller which advantageously determines the start of combustion from the measured pressure.

Preferably determining the change in the volume of the combustion chamber comes within the scope of the invention, said volume being advantageously specified by reference to the rotation angle of the crank shaft. The invention is based on the assumption that basically all the variables that change over time can also be specified or determined as a function of the crank shaft rotation angle, offering the advantage that calculation is simplified. The volume can be calculated from the crank shaft angle of rotation due to the known geometrical relationships of the internal combustion engine, since the crank shaft rotation angle gives the position of the piston in the cylinder and this in turn gives the volume of the combustion chamber. This has the advantage that when calculating the start of combustion the measured pressure and the determined volume can be taken into account so that the start of combustion can be specified with precision. Advantageously the engine controller can determine the volume by determining the angle of rotation of the crank shaft from a rotation angle sensor connected to the crank shaft and then calculating the volume from this value.

The heat and/or energy released in the combustion chamber is advantageously determined from the determined volume and the measured pressure. A differential element of the heat Q released in the combustion chamber can be determined according to the following formula:

$$dQ=(\gamma/(\gamma-1))p_c dV+(1/(\gamma-1))V dp_c$$

where $$\gamma=c_p/c_v$$

$p_c$ being the pressure in the combustion chamber in the course of a stroke with combustion (C), V being the volume of the combustion chamber, $c_p$ the specific heat capacity of the mixture at constant pressure and $c_v$ the specific heat capacity at constant volume. The variables Q, $p_c$ and V are advantageously specified as a function of the crank shaft angle of rotation CRK or as a function of the time t, the differentials dQ, $dp_c$ and dV then being determined according to the respective variable dCRK or dt. In this application the expression released heat refers to the release rate of the heat dQ or the integral of the released heat Q. The proportional value γ is not a constant quantity since it can be dependent on the temperature and pressure. Advantageously a table with different values for γ under different conditions is stored in the engine controller. Alternatively γ can be assumed a constant (e.g. 1.3), with customary values being between 1.1 and 1.4. Determining the start of combustion as a function of the calculated released heat offers the advantage that the start of combustion can be precisely specified, since a clearly noticeable quantity of heat is released at the start of combustion.

Values are preferably calculated digitally, there being three different preferred methods for digitally calculating the variable $dp_c$: (a) the current $dp_c$ is calculated from the current measured value and the last measured value, (b) the current $dp_c$ is calculated from the current measured value and the next measured value, and (c) $dp_c$ is calculated from the last and next measured value. Particularly preferred is method (c), since it works the most accurately. The value of dV is calculated in the same way, in this case the preference being not for measured values but for values calculated from the geometry as described above.

Preferably the integral of the heat released over time or as a function of the crank shaft angle of rotation is calculated according to the following formula:

$$Q=\int dQdCRK$$

or $$Q=\int dQdt$$

The start of combustion is then advantageously calculated as a function of the integral of the released heat. This gives the advantage that due to integration, transient inaccuracies in pressure measurement or in the determination of volume can be ignored in the calculation.

The integral of the released heat is preferably calculated between the start of injection and the end of combustion. This offers the advantage that computing power for the engine controller performing this calculation is needed only during the period of interest.

Advantageously a mainly stationary starting value for the integral of the released heat and a mainly stationary end value for the integral of the released heat are determined. Before and after combustion the integral of the released heat remains constant apart from very slight fluctuations, since little or no chemical energy is converted into heat in the combustion chamber.

The start of combustion can therefore be assumed to occur when the integral of the released heat exceeds a predetermined limit value which is above the starting value but below the end value. The limit value can be stored in the engine controller performing this calculation as a constant value, or be stored in a table as a function of other operating parameters of the internal combustion engine such as the mass flow rate of fuel supplied or the engine speed. A stored table is particularly advantageous, since it increases the accuracy with which values are determined.

Advantageously the mainly stationary starting value is calculated as the average value of a plurality of starting values for the integral of the released heat. Alternatively it is also possible to set the starting value for the integral to zero at the start of calculation.

A further advantageous possibility is that the limit value is adjustable, for example by a data exchange access to the engine controller during routine inspection.

The limit value is preferably predetermined as a function of the starting value and an end value. For example it is possible to forecast or estimate an end value from a preceding combustion process in a different combustion chamber of the same internal combustion engine or the same combustion chamber of the internal combustion engine. If the start of combustion is determined after the completion of combustion, the stationary end value is known from the measurement. The starting value can, as described above, be determined from the measured data or it can likewise be estimated. The limit value is then established so that for example it is above the starting value by 5% of the difference between the starting value and the end value. Further advantageous limit values are for example 2% or 10%, with the possibility for the limit value also to be variable between 5% and 10% as a function of the operating situation of the internal combustion engine, or to be correspondingly predetermined by the engine controller. The said calculations are performed by the engine controller, wherein the manner of establishing the limit value can be made adjustable and the limit values can be stored within the engine controller in a table.

Preferably the start of combustion is calculated as a function of the calculated heat release rate dQ (see formula above). It is particularly preferable for the release rate dQ to be specified as a function of the crank shaft angle of rotation CRK, the rate then being understood as a variable dependent on the crank shaft rotation angle. The start of combustion can be calculated with particular precision by this means.

It is advantageous to assume that combustion begins when the calculated heat release rate exceeds a predetermined limit value. The limit value can be predetermined as a fixed value or it can be adjustable, in which case it can also be established as a function of operating parameters of the internal combustion engine, for example as a function of the speed or the mass flow rate of the mixture supplied or further variables. Limit values dependent on the operating parameters of the internal combustion engine can be stored in the engine controller.

A tolerance range with an upper and lower limit is preferably determined for the release rate, wherein the tolerance range specifies the range within which the release rate probably lies when no combustion is taking place. The tolerance range, like the limit value, can also be established in different ways, the details of which can be found by referring to the above explanations. The limit value is then established as the upper limit of the tolerance range, where again it is assumed that combustion begins when the release rate is higher than the limit value.

The tolerance range is preferably determined from the fluctuation of the release rate during a combustion-free period. This period is preferably before the start of injection. For example the release rate can be determined starting from a particular angular position before the start of injection, such as 5° or 10°, in order to establish the tolerance range within a safety margin. Monitoring begins from the start of injection onward to determine whether the calculated heat release rate rises above the tolerance range, with the aim of detecting the start of combustion. All the calculations and analyses mentioned here can be performed in the engine controller.

A further advantageous possibility for calculating the start of combustion is to monitor the ratio between the pressure measured in the combustion chamber and a corresponding pressure at the same operating point of the internal combustion engine without combustion. When operating without combustion this pressure ratio is 1 or within a tolerance range around 1, preferably 0.95 to 1.05, but in particular preferably 0.98 to 1.02. As soon as combustion begins the pressure ratio becomes greater than 1 or rises above the tolerance range, at which point the start of combustion can be assumed. The tolerance range can therefore also be defined in one direction only, preferably 1.05 and in particular preferably 1.02.

Advantageously the measured pressure is corrected by an offset value. When the pressure is measured using the pressure sensor or other effects, an incorrect pressure can be measured or the overall operating situation of the internal combustion engine can alter in the course of its service life, so it is worthwhile introducing an offset value to correct the measured pressure so that at a combustion-free operating point it matches a corresponding stored pressure at the same combustion-free operating point.

The offset value at or before the start of injection is preferably calculated as the difference between the combustion-free pressure and the measured pressure. This has the advantage that the offset value is determined shortly before the start of combustion in order that subsequent monitoring of the start of combustion is more exact. The tolerance range for the pressure ratio can accordingly be smaller for an offset value that has been determined.

Advantageously the curve of the pressure in a combustion-free combustion chamber over time or dependent on the crank shaft rotation angle is a stored pressure curve which can be stored for example in the engine controller. This has the advantage that the pressure curve need be precisely determined once only, being thereafter corrected by the offset value while the internal combustion engine is operating.

Alternatively the curve of the pressure in a combustion-free combustion chamber over time can be determined while the internal combustion engine is operating, giving the advantage that the curve can be more effectively adapted to altered operating conditions in the internal combustion engine.

The features mentioned offer special advantages when used in combination, since a combination of the different options for calculating the start of combustion from the pressure gives the advantage that determination of the start of combustion is not subject to error if, for example, the start of combustion is assumed when the heat release rate and the calculated released heat are both monitored, since error correction then makes it possible to proceed on the basis of narrower tolerance limits. It can be further envisaged that both methods are combined with the pressure ratio method in order to make monitoring more effective.

Advantageously in the scope of the invention the quantity of a recirculated exhaust gas is influenced as a function of the determined start of combustion. This offers the advantage that exhaust gas feedback makes it possible to design efficient and environmentally friendly combustion.

The start of combustion is preferably determined while combustion is still taking place. This makes it possible and advantageous for exhaust gas feedback or post-injection to be performed by reference to the start of combustion while still within the current stroke.

In further advantageous embodiments the start of injection or the injection period of a pre-injection, a main injection or a post-injection in the combustion chamber is influenced by reference to the determined start of combustion for the purpose of improving said combustion.

A further independent object of the invention is an engine controller, configured or programmed so that a method with the advantageous features mentioned above can be performed. For this purpose the said engine controller is connected to a pressure sensor or a rotation angle sensor for the crank shaft as previously described.

A further independent object of the invention is the use of an engine controller for performing a method with a combination of the advantageous features mentioned above.

It should be noted that the invention is preferably used in internal combustion engines with more than one cylinder.

Figure 2:
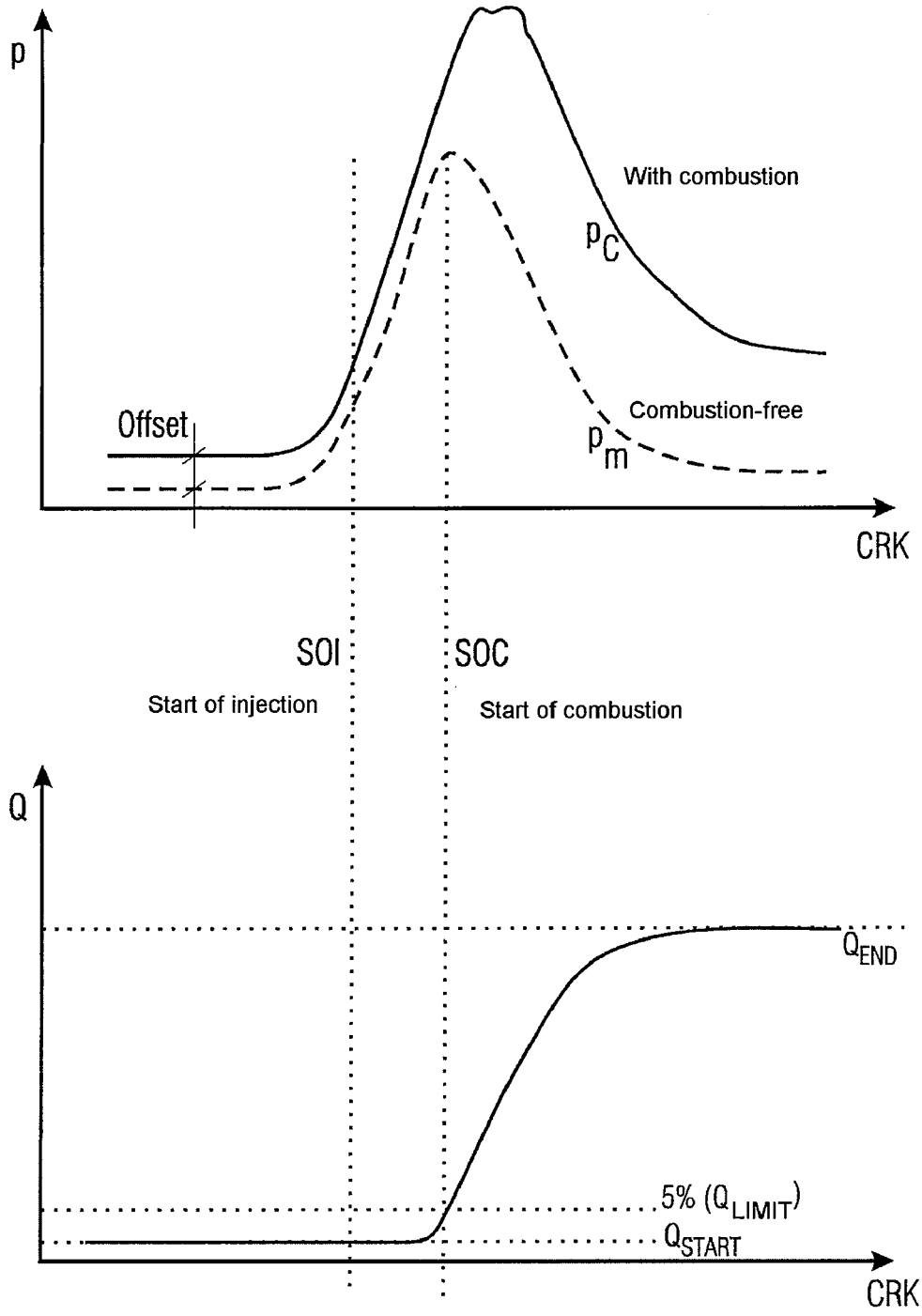
FIG. 2 shows diagrams used in the method shown in FIG. 1.

FIG. 1, which is described below together with FIG. 2, shows the flowchart of a method for determining the start of the combustion of a mixture in the combustion chamber of an internal combustion engine. The method is performed by an engine controller which is connected to various sensors. In detail, the engine controller is connected to a pressure sensor which measures the pressure $p_c$ in the combustion chamber, and receives signals from a rotation angle sensor which detects the rotation angle of the crank shaft CRK. The engine controller can use the established rotation angle of the crank shaft CRK at any time to determine the volume V of the combustion chamber in which the mixture is burning. The engine controller continuously controls injection of the mixture into the combustion chamber and thus also has injection-related information in its possession.

The method begins by waiting for an injection to begin (start of injection, SOI). With effect from the moment at which the injection starts, the pressure $P_c$ (CRK) in the combustion chamber is continuously detected. At the same time the crank shaft rotation angle CRK is used to determine the volume V(CRK) of the combustion chamber. A differential dQ(CRK) of the heat released in the combustion chamber is continuously calculated from the measured pressure $p_c$(CRK) and the volume V(CRK). The differentials dQ(CRK) are integrated into an overall integral for released heat Q(CRK). If the integral for the released heat Q(CRK) is increasing, this means that combustion is still taking place. As soon as the integral for released heat Q(CRK) reaches a stationary value or reaches a mainly stationary value, i.e. is changing only a little, it is assumed that the combustion process is finished.

FIG. 2 shows a function curve of the pressure $p_c$(CRK) measured in the combustion chamber (pressure measured by reference to the crank shaft rotation angle with combustion in progress) and a stored, idealized curve of combustion-free pressure $P_m$(CRK) (motored pressure, m). Even before combustion these two pressure curves are showing a deviation which may originate from measurement errors or from the possibility that the physical ratios in the combustion chamber do not correspond to those on which the idealized curve of combustion-free pressure $P_m$(CRK) is based. This deviation is known as offset. The engine controller determines this offset during combustion-free operation (before the start of injection) and subsequently takes this offset into account in the analysis.

The lower diagram in FIG. 2 shows the integral for the released heat Q(CRK). The lower diagram, like the upper diagram, is plotted against the crank shaft rotation angle CRK, the crank shaft rotation angle CRK and the time t being dependent on one another in direct proportion at constant speed. On the time line (or CRK) in both diagrams, two instants are identified by vertical broken lines; these are the start of injection (SOI) and the start of combustion (SOC). With effect from the start of combustion the measured pressure $p_c$(CRK) deviates markedly from the ideal curve of combustion-free pressure $P_m$(CRK). This deviation is brought about by the onset of combustion. Likewise the integral of the released heat Q(CRK) increases markedly with effect from this instant.

In the method shown in FIG. 1 the stationary starting value of the released heat $Q_{START}$ and the value of the integral $Q_{END}$, which is stationary once combustion is finished, are used in order to calculate a limit value $Q_{LIMIT}$. The limit value $Q_{LIMIT}$ is situated above the starting value $Q_{START}$ by 5% of the difference between the starting value $Q_{START}$ and the end value $Q_{END}$, as FIG. 2 shows. In the method it is furthermore assumed that the start of combustion has to be set to the instant at which the integral of the released heat Q(CRK) exceeds limit value $Q_{LIMIT}$. The crank shaft rotation angle CRK is then output as the start of combustion at which the integral Q(CRK) exceeds the limit value $Q_{LIMIT}$. The method is then completed and can be repeated for example in the next stroke of the internal combustion engine. The results can be used to alter a subsequent injection process in order to bring about improved combustion.

Figure 3:
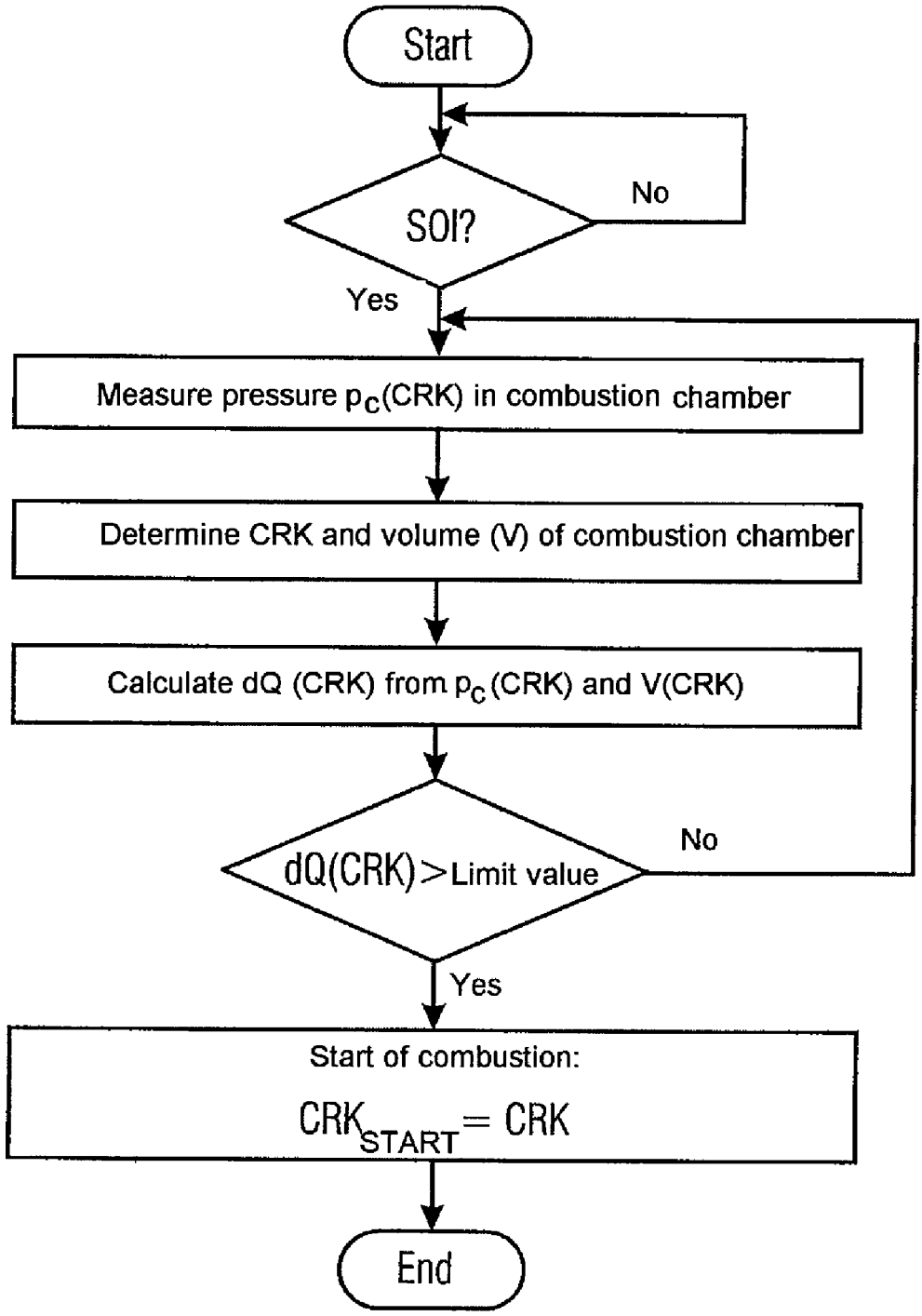
FIG. 3 shows a flowchart of a further inventive method for determining the start of combustion.
Figure 4:
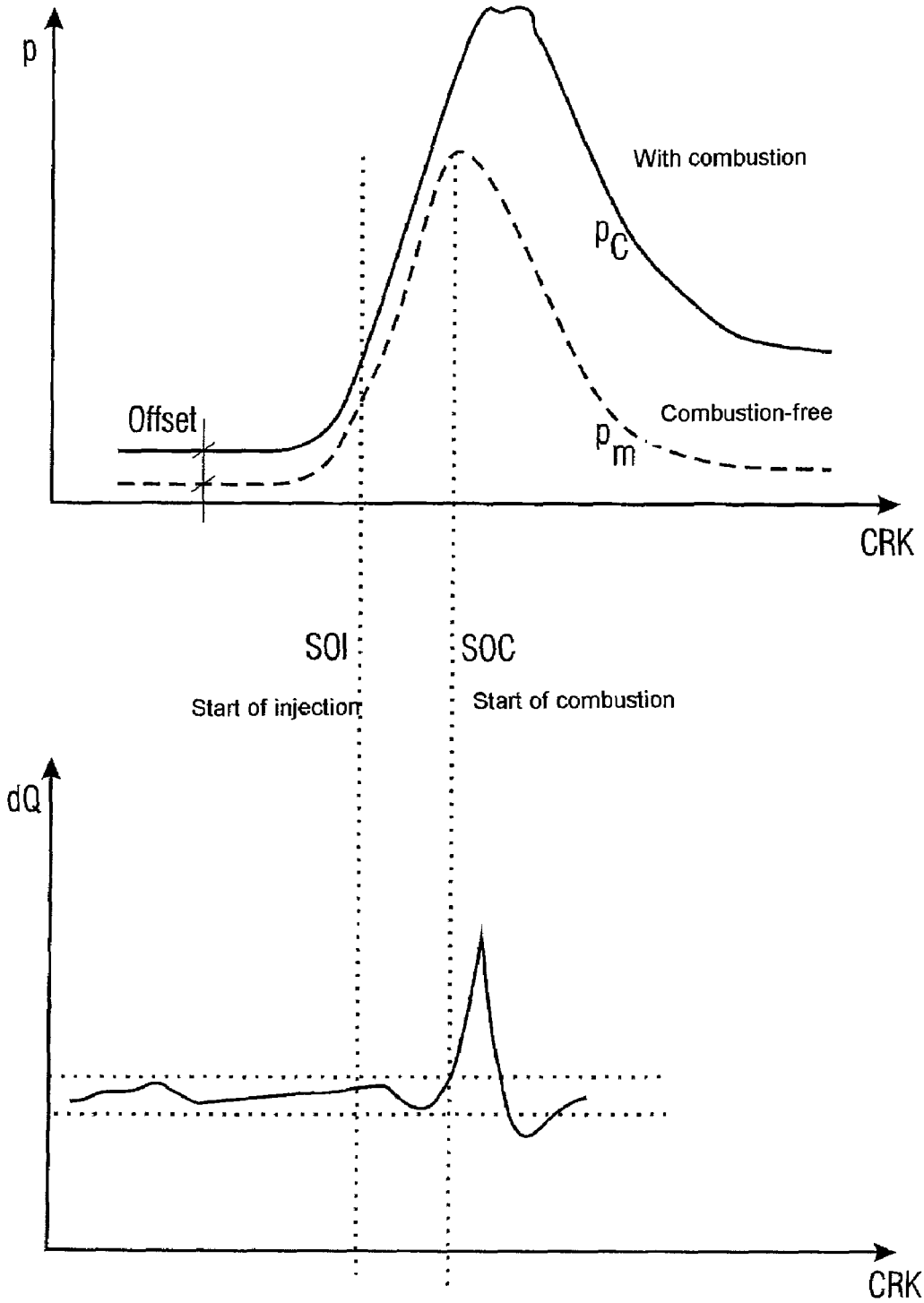
FIG. 4 shows diagrams used in the method shown in FIG. 3.

FIGS. 3 and 4 are described together below, where reference is made to the names used in connection with the descriptions of FIGS. 1 and 2, and the said variables are not described in full over again.

FIG. 3 shows a flowchart of a method in which the start of combustion is deduced directly from the release rate of the released heat. In this case the release rate is known as the differential dQ(CRK). This release rate is calculated as described in FIG. 1 and the associated description. If dQ(CRK) is greater than a previously established limit value $dQ_{LIMIT}$, it is assumed that combustion is starting. The limit value $dQ_{LIMIT}$ can be established prior to combustion, for example by reference to the fluctuations of dQ(CRK), or can be stored in the engine controller as a fixed parameter.

Figure 5:
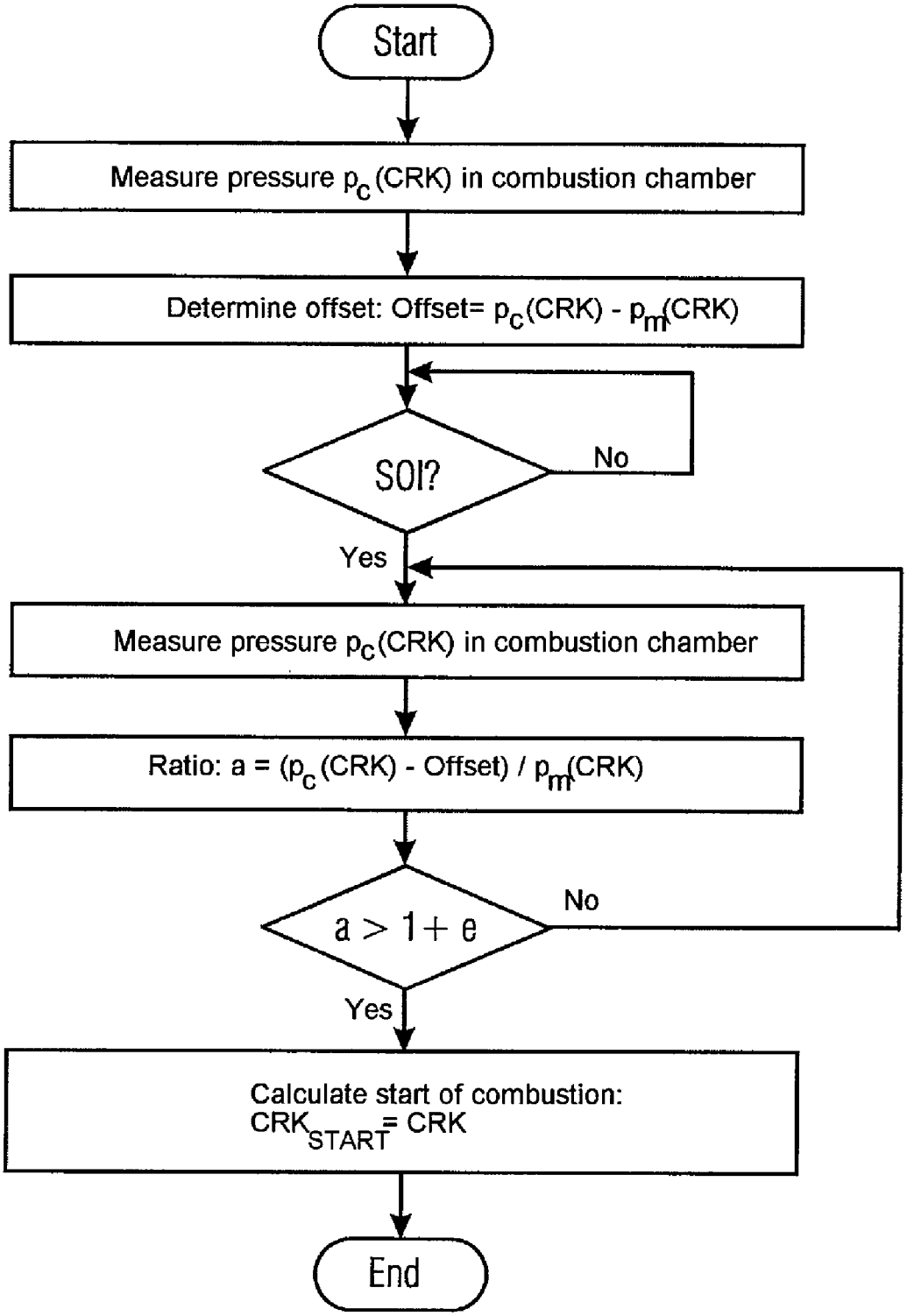
FIG. 5 shows a flowchart of another inventive method for determining the start of combustion.
Figure 6:
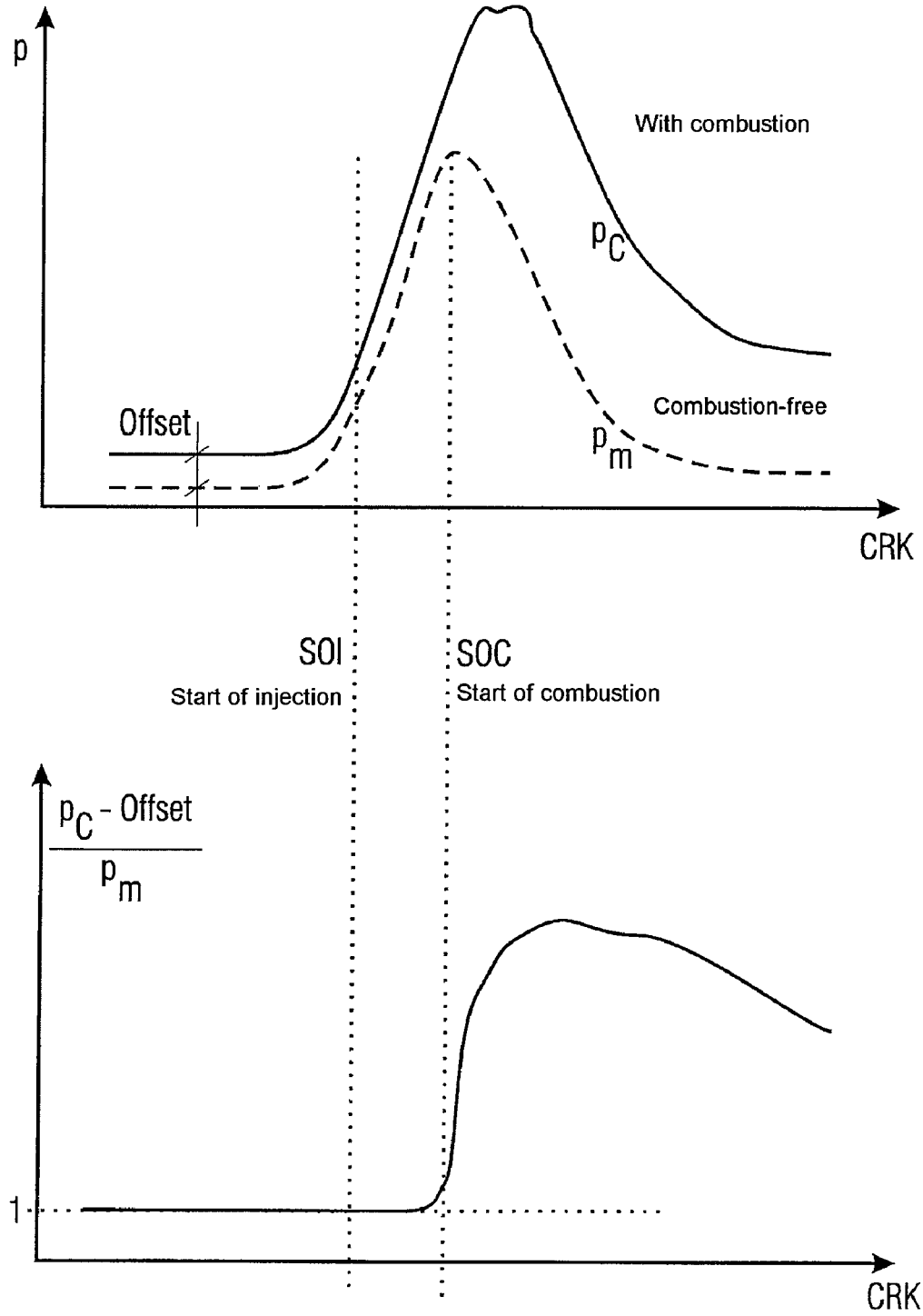
FIG. 6 shows diagrams used in the method shown in FIG. 5.

FIGS. 5 and 6 show a further method for determining the start of combustion. The method uses the finding that at the start of combustion the pressure $p_c$(CRK) differs noticeably from the pressure curve $p_m$(CRK) which represents the pressure curve in the absence of combustion. The names of the variables and parameters can be found by referring to earlier descriptions concerning FIGS. 1 to 4.

First of all the method shown in FIG. 5 determines the offset that specifies the amount by which the measured pressure $p_c$(CRK) deviates from the stored pressure curve $p_m$(CRK) The offset is determined before the start of injection, since it can be assumed at this point in time that the measured pressure curve $p_c$(CRK) conforms to an ideal pressure curve. The pressure curve $p_m$(CRK) is stored in the engine controller as a function of different relevant operating parameters of the internal combustion engine and is specific to said internal combustion engine.

After determining the offset the method waits until injection begins. Then the pressure $p_c$(CRK) in the combustion chamber is again measured, after which the ratio of the measured pressure, corrected by the offset, to the stored pressure is calculated. This ratio is calculated according to the formula $a=(p_c(CRK)-offset)/p_m(CRK)$. Next the method checks whether the ratio a is around 1, in particular checking whether a is greater than 1+e. The limit value e, which can be for example 0.05 or 0.1, has been established in advance and stored in the engine controller. If a is greater than 1+e, it is assumed that combustion is starting, and the start of combustion $CRK_{START}$ (specified as a crank shaft rotation angle) is set at the current crank shaft rotation angle CRK.

The methods shown in the exemplary embodiments can also be used in any combination, making it possible for the method to carry out checks on itself and thus enhancing the reliability with which the start of combustion can be determined.

The invention is not confined to the preferred exemplary embodiment described above. Instead a plurality of variants and adaptations is possible, likewise making use of the ideas behind the invention and therefore falling within the scope of protection.

What is claimed is:

1. A method for determining the start of combustion of a mixture in the combustion chamber of an internal combustion engine, comprising the following step:

determining a start of injection, continuously measuring form said start of injection the pressure in the combustion chamber, and determining the start of combustion by reference to the continuously measured pressure, wherein said start of combustion is determined when a value derived from said continuously measured pressure exceeds a pre-defined threshold.

2. The method as claimed in claim 1, further comprising the following steps:

determining the volume of the combustion chamber and determining said value by reference to the measured pressure and the determined volume.

3. The method as claimed in claim 2, further comprising the following steps:

calculating the heat released in the combustion chamber by reference to the determined volume and the measured pressure and determining said value from the calculated released heat.

4. The method as claimed in claim 3, further comprising the following steps:

calculating an integral of the released heat and determining the value by reference to the integral of the released heat.

5. The method as claimed in claim 4, wherein the integral of the released heat is calculated between the start of injection and the end of combustion.

6. The method as claimed in claim 4, further comprising the following steps:

determining a mainly stationary starting value for the integral of the released heat, determining a mainly stationary end value for the integral of the released heat and assuming the start of combustion when the integral of the released heat exceeds a predetermined limit value which is between the starting value and the end value.

7. The method as claimed in claim 6, wherein the starting value is calculated as the average value of a plurality of starting values for the integral of the released heat or for the released heat.

8. The method as claimed in claim 6, wherein the limit value is adjustable.

9. The method as claimed in claim 6, wherein the limit value is above the starting value by a predetermined percentage of the difference between the starting value and the end value.

10. The method as claimed in claim 2, further comprising the following steps:

determining the heat release rate and determining the start of combustion by reference to the calculated release rate.

11. The method as claimed in claim 10, further comprising the following step:

assuming that the start of combustion occurs when the calculated heat release rate exceeds a predetermined limit value.

12. The method as claimed in claim 11, further comprising the following steps:

determining a tolerance range for the calculated release rate having an upper and a lower limit and establishing the predetermined limit value as the upper limit of the tolerance range.

13. The method as claimed in claim 12, wherein the tolerance range is determined from the fluctuation of the release rate during a combustion-free period and/or during a period before the start of injection.

14. The method as claimed in claim 1, wherein the following steps:

determining the ratio between the pressure measured in the combustion chamber and a corresponding pressure at the same operating point of the internal combustion engine without combustion, assuming that the start of combustion occurs when the pressure ratio ($\alpha$) exceeds a predetermined limit value.

15. The method as claimed in claim 14, wherein the measured pressure is corrected by an offset value.

16. The method as claimed in claim 15, wherein the offset value at the start of injection is calculated as the difference between the combustion-free pressure and the measured pressure.

17. The method as claimed in claim 14, wherein the curve of the pressure in a combustion-free combustion chamber is a stored pressure curve.

18. The method as claimed in claim 14, wherein the curve of the pressure in a combustion-free combustion chamber is determined while the internal combustion engine is operating.

19. The method as claimed in claim 3, wherein the start of combustion is determined as a function of the calculated release rate and/or as a function of the calculated released heat and/or as a function of the pressure ratio between the measured pressure in the combustion chamber and a corresponding pressure at the same operating point of the internal combustion engine without combustion.

20. The method as claimed in claim 1, wherein the start of combustion is determined while combustion is still taking place or before the next start of injection.

21. The method as claimed in claim 1, wherein the quantity of a recirculated exhaust gas is influenced as a function of the determined start of combustion.

22. The method as claimed in claim 1, wherein the start of injection and/or the injection period of a pre-injection, a main injection and/or a post-injection in the combustion chamber is influenced by reference to the determined start of combustion.

23. An engine controller for determining the start of combustion of a mixture in the combustion chamber of an internal combustion engine, comprising:

means for determining a start of injection, means for continuously measuring the pressure in the combustion chamber from said start of injection, and means for determining the start of combustion by reference to the continuously measured pressure, wherein said means for determining are operable to determine the start of combustion when a value derived from said continuously measured pressure exceeds a pre-defined threshold.

24. A method as claimed in claim 1, further comprising the step of using an engine controller for performing the method.

* * * * *